US007293493B2

(12) United States Patent
Persson et al.

(10) Patent No.: US 7,293,493 B2
(45) Date of Patent: Nov. 13, 2007

(54) WEAPON SIGHT

(75) Inventors: Rolf Persson, Karlskoga (SE); Ulf Palmlöv, Degerfors (SE); Jörgen Bergmark, Örebro (SE)

(73) Assignee: BAE Systems Bofors AB, Karlskoga (SE)

( * ) Notice: Subject to any disclaimer, the term of this patent is extended or adjusted under 35 U.S.C. 154(b) by 120 days.

(21) Appl. No.: 10/496,117

(22) PCT Filed: Oct. 9, 2002

(86) PCT No.: PCT/SE02/01829

§ 371 (c)(1),
(2), (4) Date: Oct. 13, 2004

(87) PCT Pub. No.: WO03/054471

PCT Pub. Date: Jul. 3, 2003

(65) Prior Publication Data

US 2005/0066807 A1 Mar. 31, 2005

(30) Foreign Application Priority Data

Nov. 19, 2001 (SE) ..... 0103828

(51) Int. Cl.
*F41A 27/06* (2006.01)
*F41G 5/00* (2006.01)

(52) U.S. Cl. ..... 89/41.02; 89/41.14; 89/41.15; 89/41.22

(58) Field of Classification Search ..... 89/37.01, 89/41.02, 41.07, 41.22, 41.05, 41.14, 41.15
See application file for complete search history.

(56) References Cited

U.S. PATENT DOCUMENTS

| | | | | | |
|---|---|---|---|---|---|
| 1,523,317 | A | * | 1/1925 | Turner | 89/7 |
| 2,410,723 | A | * | 11/1946 | Byrum et al. | 318/55 |
| 2,444,246 | A | * | 6/1948 | Chase et al. | 89/37.01 |
| 2,569,571 | A | * | 10/1951 | Tear et al. | 89/41.12 |
| 3,290,992 | A | * | 12/1966 | Blomqvist | 89/41.07 |
| 3,685,159 | A | * | 8/1972 | Erhard | 89/204 |
| 3,759,138 | A | * | 9/1973 | Schrage | 89/37.01 |
| 3,798,795 | A | * | 3/1974 | Michelsen | 434/19 |
| 4,579,035 | A | * | 4/1986 | Whiting | 89/41.05 |
| 4,787,291 | A | | 11/1988 | Frohock, Jr. | |
| 5,001,985 | A | | 3/1991 | Reid et al. | |
| 5,129,307 | A | * | 7/1992 | Cain et al. | 89/1.815 |
| 5,686,690 | A | | 11/1997 | Lougheed et al. | |
| 5,949,015 | A | * | 9/1999 | Smith et al. | 89/41.05 |
| 5,992,292 | A | * | 11/1999 | Ennenga | 89/41.22 |
| 6,499,382 | B1 | * | 12/2002 | Lougheed et al. | 89/41.05 |
| 6,769,347 | B1 | * | 8/2004 | Quinn | 89/41.05 |

* cited by examiner

*Primary Examiner*—Bret Hayes
(74) *Attorney, Agent, or Firm*—Connolly Bove Lodge and Hutz

(57) ABSTRACT

This invention, as a unit, is a training adjustable combination sight, primarily intended to be mounted on a vehicle of smaller vessel for close-in defence of these against air and ground attacks. In its entirety, aside from the required sight sensors (16-18) situated in an intentionally elevatable sensor housing (4), the combination sight entails a weapon (8) that is sensors. The sight sensors (16-18) included in the combination sight can also be utilised for fire control of exterior weapons located elsewhere as well as for gathering purely surveillance data.

20 Claims, 3 Drawing Sheets

WEAPON SIGHT

CROSS REFERENCE TO RELATED APPLICATION

The present application is a National Phase application of PCT/SE029/01829, filed Oct. 9, 2002, which claims priority from Swedish Patent Application No. 0103828-0, filed Nov. 19, 2001.

This invention is a combination sight, primarily intended to be mounted on a vehicle or small vessel for close-in defence of these and against air and ground assaults. The complete combination sight is includes its own internal weapon controlled by the sight sensors. The sight sensors included in the combination sight can also be utilised for fire control of exterior weapons located elsewhere as well as for gathering purely surveillance data.

Whereas previously when faced especially with surprise air-attacks against single vehicles and smaller vehicle groupings, without advanced immediate air and ground defences, it was virtually necessary to direct the fastest and largest possible armed forces against an attacker with the best infantry weapons available, and thus more or less applied the shotgun principle. The risk for surprise air attacks have not only considerably increased with the introduction of the attack helicopter but so has the effect of such attacks. The need for sensor-controlled close-in defence weapons that can rapidly and effectively provide well-aimed fire against attacking enemy aircraft is, therefore, great.

New sensor technology combined with micro-electronics and the enormous development in recent years in computer technology has made it possible to equip a single vehicle with an advanced sight, capable of increased multifaceted defence possibilities against rapidly evolving attacks. There are different types of weapons that do not generate recoil forces than are encountered in a well-planned design, combining sight sensors directly from today's market and which, with target impact, are effective even against attack helicopters, lighter armored vehicles or employed against strictly infantry targets.

Weapon forms appropriate to the context are exemplified by the 0.50 caliber and 14.5 mm heavy machine guns, that are already deployed in large numbers in the armies of the world as well as the rapid fire grenade canons of recent years.

The basic principle for the combination sight as defined in this invention is that through modular adaptation it is possible with a small number, namely three, conceptually distinct but functionally able to be integrated with basic modules, making it possible to produce a basic sight, an armed sight or a machine-controlled weapon platform. The combination sight, as defined in this invention, shall also be able, when mounted with its advanced sensors on a battle tank, to be used as a shielded and highly effective surveillance platform.

A modular design providing the greatest possible flexibility, while in itself complicated, is not a new basic principle, however, to the best of our knowledge there are no earlier machine-controlled weapon sights that can function both purely as a weapon sight or as a platform for the weapon whose function it controls and whose operating module can also, if necessary, be converted into a pure weapon platform should for example the sight be damaged. According to this invention it is also possible via the utilisation of many of its basic modules to build a weapon sight systems where the various components are individually installed on the vessel or vehicle onto which they are mounted.

Thus, the combination sight, as defined in this invention, first entails (in relation to the vehicle or vessel on which the combination is mounted) a rotational operating, or base module, with a sensor module installed on said module and an installable weapon module above the sensor module, should such be desired.

The base module, included in the combination sight, as defined in this invention, is responsible for the system's training and, to a lesser extent, elevation of the sensor module and thus includes the complete laying motor for the entire combination sight, the associated training brake, and, if necessary, a collective training and elevation motor for all or part of the entire combination sight. The control electronics required for the entire combination sight are appropriately located in the operating, or base, module. Thus, all the variants of the required components for the combination sight are located in the operating or base module.

The sensor module, inclusive of all the sight sensors, is in normal cases mounted directly above the operating module and there its elevation is controlled by the elevation motor in the operating or base module simultaneously as it follows the training of the base module on which it is mounted. The sensor module, thus, includes an elevation-controlled sensor housing shielded against external damage including all sensors, whereof the sensor housing is preferably able to rotate around a horizontal axis, that is journalled in two mutually opposed lifting arms or consoles, vertical to said sensor module, on each side of the rotational sensor housing, which, aside from supporting the sight module's elevation axis, also provide space for all necessary communication between the operating module and the sensor module. The elevation motor in the operating module equipped with a synchronous drive belt, or some equivalent thereto, installed in each of the lifting arms or consoles can control the elevation of the sensor housing. The lifting arms or consoles can also provide space for such extra constituent parts as cooling channels for the circulation of cooling air and, in particularly hot climates, cooling elements for the circulating air.

Above the sensor module, should such be desired, a weapon module can be mounted entailing two mutually opposed vertical extensions of the sensor housing journals that support the lifting arms or consoles and obtaining between these two is their own elevation-journalled horizontal axis, as its elevation is driven by the elevation motor via at least one of the sensor housing journals linked to the weapon.

With this arrangement, the weapon and sensors follow one another in elevation as well as training because the same elevation motor controls the elevation of both modules elevation even if one of the elevatable modules' own elevation motor functions on its own, while both units function as a single unit with regard to training. According to another variant, the weapon is equipped with its own elevation motor that is both mechanical, e.g., synchronous belt drive, as it is electrical, connected to the elevation motor in the operating module such that both moth motors act as a single unit. The benefit of this configuration, among other things, is that the elevation motor in the operating module can be devoted solely to the moving mass of the sensor module and also need not be dimensioned for a weapon, which may not always be mounted. Generally, as the weapon shall have greater a mass than the sensor module and shall need to be kept still during fire, and appropriately it shall be equipped with its elevation brake.

Aside from the aforementioned, it also applies that the interfaces or places of interconnection between the operating module and the sensor module as well as between the sensor module and the weapon module shall be identically designed, which means that the sensor module can, if necessary, be excluded and the entire sight-weapon combination is converted to a pure weapon platform. It can be advantageous in those cases where special considerations mean that the weapon and sight should be mounted separately. Further, intermediary devices mounted between the module units can be used to provide the sensor housing and/or the weapon with extreme elevation possibilities adapted for particular areas of use (elevation purposes).

With the weapon mounted above the sight, feeding rounds to the weapon needs to be resolved in a special way, but because the weapons are primarily thought to be used in connection with the combination sight as defined in this invention they shall be belt-fed rounds, thus a feed control for the round belt from the main magazine to the weapons load feeder must be designed and this feed control can, in most cases, be designed with very simple means. Thus, the main magazine would be aptly mounted on the base module so that it follows the same training.

This invention is defined in the patent claims and is now described in more detail with reference to the illustrations shown in the appended Figures.

In these figures

Figure 1:
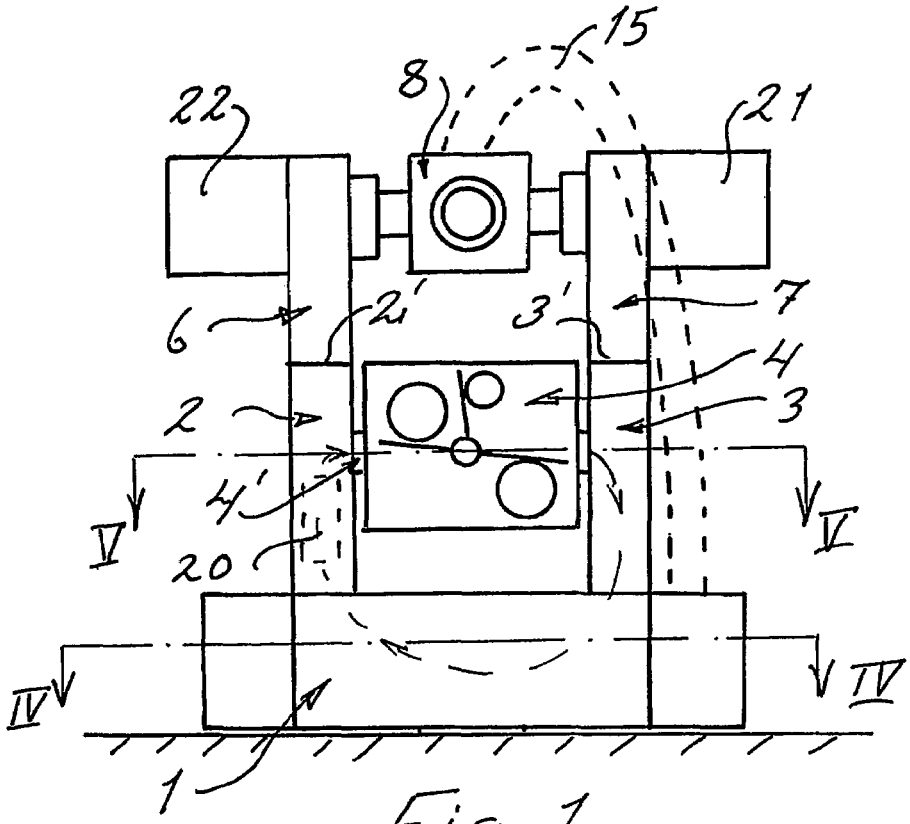
FIGS. 1, 2 and 3 show the complete combination sight seen from the front, side and from above.
Figure 2:
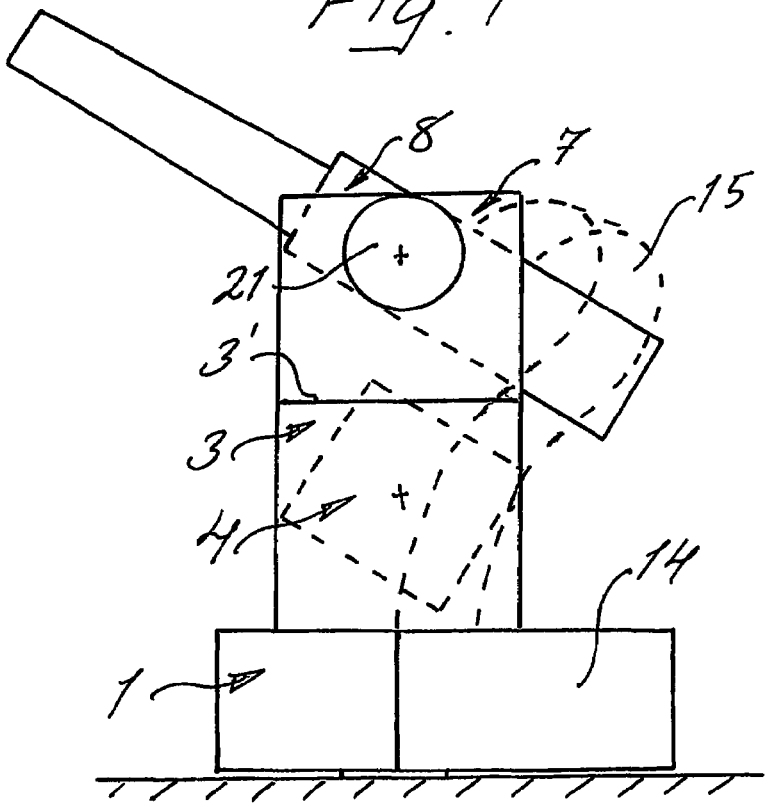

All constituent parts, to the extent they appear, have been given the same designations on the different figures.

The main sections in the complete combination sight are a base or operating module (1), two vertical sensor consoles (2 & 3), a sensor housing (4), two vertical weapon consoles (6 & 7) and the weapon (8). A heavy machine gun, a mortar or other automatic loading weapon with such a limited recoil that the weapon recoil shall not damage the sensors in the sensor housing.

Figure 4:
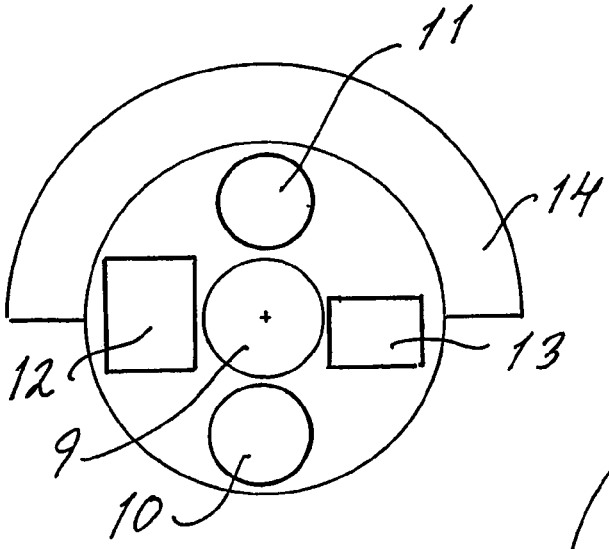
FIG. 4 shows sections IV-IV in FIG. 1.
Figure 5:
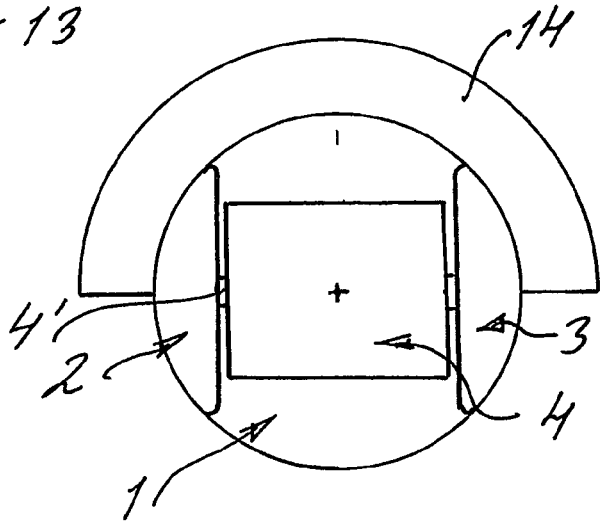
FIG. 5 shows sections V-V in FIG. 1.
Figure 3:
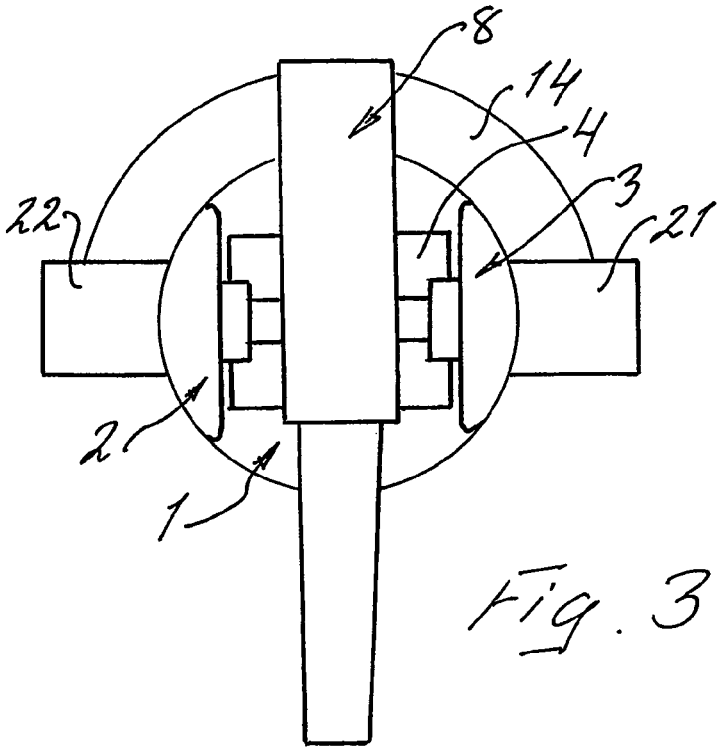

The base or operating module, whose main components are shown in FIG. 4, entails a central vertical rotation bearing (9), around which the entire combination sight can rotate a full revolution. There are also slip ring connections, in relation to this rotation bearing, for the transfer of operating electricity and the execution of operating commands. Further, there is a training motor (10), a training brake (11) and space for control electronics (12) and an elevation motor (13). The latter is primarily adapted for the elevating the sensor housing (4), e.g., through one of the synchronous drive belts in the sensor consoles (2 & 3). A half-moon shaped round magazine is permanently mounted on the base module. The round magazine thus follows the training of the base module. The weapon (8) round belt runs from the magazine (14) through a round leader (15) to the loading position of the weapon.

The elevation supported sensor housing (4), between both vertical sensor consoles (2 & 3), are equipped with three sensor windows (16-18) that are intended for a video camera (16), an IR camera (17) and a laser range finder (18). Sensor housing (4) is equipped with a forward and return three-armed window wiper (19) for cleaning the sensor windows.

Sensor consoles pairs 2,3 and 6,7 can replace one another as well as being able to be linked together in that the interfaces between them and the selectable consoles and the base module are designed to make this possible, which, in itself, also means that all electrical contact routes can be maintained regardless of the console being used. The consoles can also be used for other purposes, e.g., to circulate cooling air. If the combination sight, as defined in this invention, shall be used in a very hot climate a cooling element (20) can be located in one of the consoles that the cooling air can pass through during circulation. As earlier indicated, the elevation of the sensor housing can be driven primarily by a synchronous drive belt, or some equivalent thereof, from the elevation motor (13) in the base module through one of the consoles. Theoretically, the weapon could have its elevation controlled in the same way but because the weapon, in most cases, shall have the greatest individual mass it can be more appropriate (as a rule) to, as indicated by FIG. 1, provide the weapon with its own elevation motor (21) controlled in parallel with the sensor housing elevation motor (13). FIG. 1 also has a weapon brake specified in the drawing. Weapon brake (22) is tasked with rapidly stopping the horizontal motion of the weapon connected to the sight at the same instant as the sight acquires the target and the weapon is held still while firing.

As indicated earlier, console pairs 2,3 and 6,7 can replace one another. In addition to linked consoles that provide extremely large elevation angles can be used if necessary. Such is exemplified in FIG. 7, where 23 and 24 designate them, but 24 is hidden in the figure.

Figure 6:
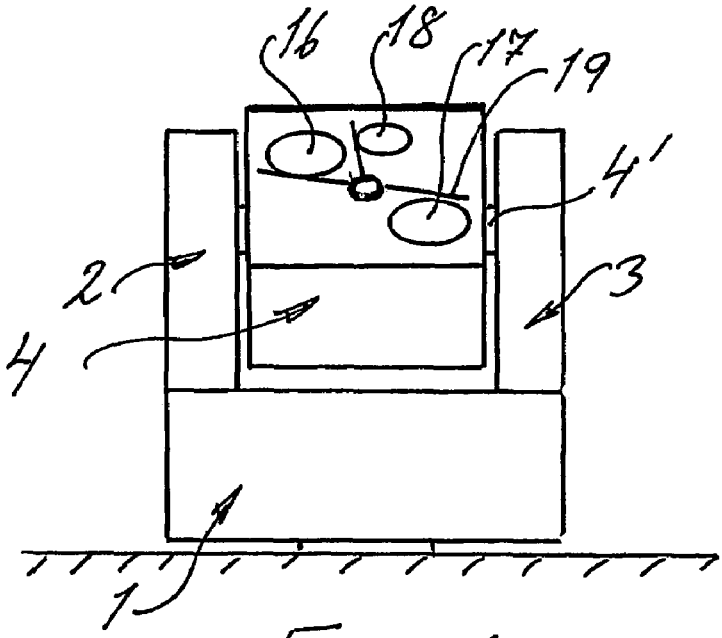
FIG. 6 shows from the front a separate use of the sensor module of the combination sight only.
Figure 7:
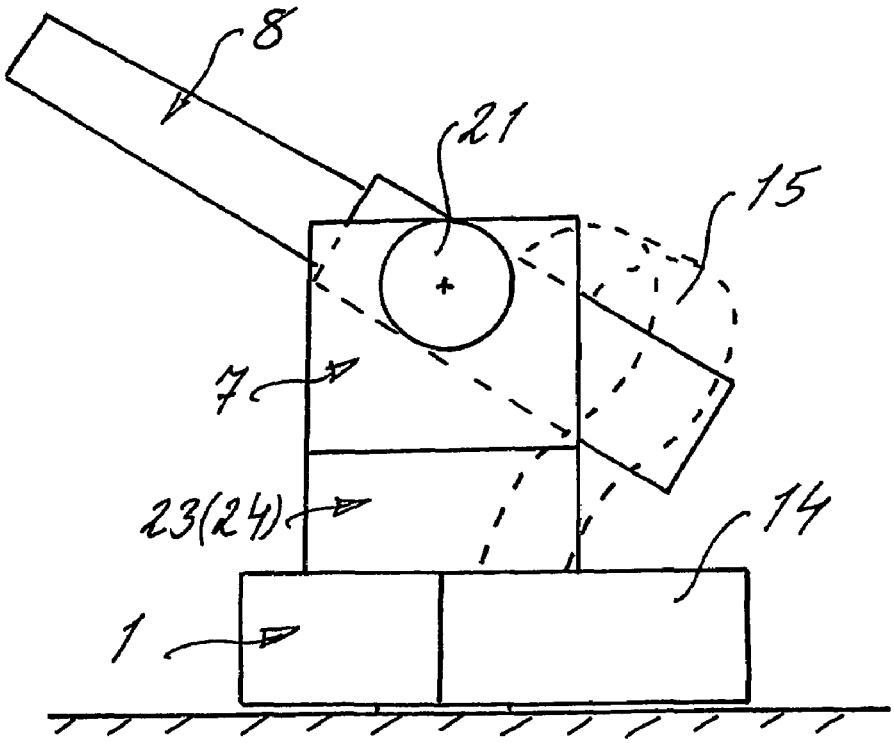
FIG. 7 shows a side view of a separate use of the weapon section.

Because the consoles have the maximum degree of interchangeability, they make possible the sight and surveillance module, indicated in FIG. 6, that can be used to control separately mounted weapons as well as the pure weapon module indicated in FIG. 7, which, thus, can be controlled by a separately mounted sight module, as indicate din FIG. 6. Reprogramming of the weapon control algorithms used is required to accommodate having the sight module and weapon module located beside one another and at a given distance from one another, but this only requires the use of current conventional technology.

The invention claimed is:

1. A method of building a machine-controlled sight-weapon combination, said method comprising:

providing at least one training-adjustable base module containing at least a sight training motor, control electronics and an elevation motor;

installing at least one pair of vertically-protruding, mutually opposed weapon consoles or weapon lifting arms upon said at least one training-adjustable base module;

installing a pair of vertically-protruding, mutually opposed sensor housing consoles or sensor housing lifting arms upon said at least one training-adjustable base module;

installing a weapon between said at least one pair of vertically-protruding, mutually opposed weapon consoles or weapon lifting arms, and relative to a vehicle or vessel for which the sight-weapon combination is intended, so as to form at least one weapon module; and installing a sensor housing between said at least one pair of either consoles or lifting arms, and relative to said vehicle or vessel, so as to form a sensor housing module, wherein said sensor housing contains sight sensors which control said weapon and said sensor housing in parallel, and wherein said weapon module and said sensor housing module can be configured either as a combined sight-weapon unit upon a same base module of said at least one training-adjustable base module or as separate units upon separate base modules of said at least one training-adjustable base module.

2. A sight-weapon combination built in accordance with the method of claim 1, wherein:

said weapon module and sensor housing module are of modular design above said at least one base module;

said vehicle or vessel contains said at least one base module;

said at least one base module is training-adjustable in relation to the vehicle or vessel and contains fixture points for said at least one pair of vertically-protruding, mutually opposed weapon consoles or lifting arms or said pair of vertically-protruding, mutually opposed sensor housing consoles or lifting arms;

said sensor housing is suspended in elevation from a horizontal axle, and said at least one pair of vertically-protruding, mutually opposed weapon consoles or weapon lifting arms extends from free ends of said pair of vertically-protruding, mutually opposed sensor housing consoles or sensor housing lifting arms.

3. The sight-weapon combination of claim 2, wherein the sensor housing can be entirely replaced with other consoles or lifting arms and the weapon can be suspended in elevation between said at least one pair of vertically-protruding, mutually opposed weapon consoles or weapon lifting arms while weapon fire control may come from another sight-weapon combination.

4. The sight-weapon combination of claim 3, wherein said at least one pair of vertically-protruding, mutually opposed weapon consoles or weapon lifting arms and said pair of mutually-opposed sensor housing consoles or sensor housing lifting arms provide space and transmission means for command and control connections between different moving parts of the combination sight-weapon.

5. The sight-weapon combination of claim 3, wherein the pair of vertically-protruding, mutually opposed sensor housing consoles or sensor housing lifting arms provide circulation channels for cooling air around the sight sensors in the sensor housing.

6. The sight-weapon combination of claim 3, wherein the at least one pair of vertically-protruding, mutually opposed weapon consoles or weapon lifting arms and said pair of mutually-opposed sensor housing consoles or sensor housing lifting arms are extendable with intermediary devices for increasing elevation angles of elevatable parts without impinging on functioning of the sight sensors or the weapon.

7. The sight-weapon combination of claim 3, wherein said weapon is a heavy machine gun or mortar and is connected to said sight sensors such that said sight sensors control firing of said weapon.

8. The sight-weapon combination of claim 3, wherein the weapon has a magazine which is connected to said at least one base module such that the weapon always follows the training of said at least one base module.

9. The sight-weapon combination of claim 2, wherein said at least one pair of vertically-protruding, mutually opposed weapon consoles or weapon lifting arms and said pair of mutually-opposed sensor housing consoles or sensor housing lifting arms provide space and transmission means for command and control connections between different moving parts of the combination sight-weapon.

10. The sight-weapon combination of claim 9, wherein the pair of vertically-protruding, mutually opposed sensor housing consoles or sensor housing lifting arms provide circulation channels for cooling air around the sight sensors in the sensor housing.

11. The sight-weapon combination of claim 9, wherein the at least one pair of vertically-protruding, mutually opposed weapon consoles or weapon lifting arms and said pair of mutually-opposed sensor housing consoles or sensor housing lifting arms are extendable with intermediary devices for increasing elevation angles of elevatable parts without impinging on functioning of the sight sensors or the weapon.

12. The sight-weapon combination of claim 9, wherein said weapon is a heavy machine gun or mortar and is connected to said sight sensors such that said sight sensors control firing of said weapon.

13. The sight-weapon combination of claim 9, wherein the weapon has a magazine which is connected to said at least one base module such that the weapon always follows the training of said at least one base module.

14. The sight-weapon combination of claim 2, wherein the mutually opposed sensor housing consoles or sensor housing lifting arms provides circulation channels for cooling air around the sight sensors in the sensor housing.

15. The sight-weapon combination of claim 14, wherein the at least one pair of vertically-protruding, mutually opposed weapon consoles or weapon lifting arms and said pair of mutually-opposed sensor housing consoles or sensor housing lifting arms are extendable with intermediary devices for increasing elevation angles of elevatable parts without impinging on functioning of the sight sensors or the weapon.

16. The sight-weapon combination of claim 14, wherein said weapon is a heavy machine gun or mortar and is connected to said sight sensors such that said sight sensors control firing of said weapon.

17. The sight-weapon combination of claim 2, wherein the at least one pair of vertically-protruding, mutually opposed weapon consoles or weapon lifting arms and said pair of mutually-opposed sensor housing consoles or sensor housing lifting arms are extendable with intermediary devices for increasing elevation angles of elevatable parts without impinging on functioning of the sight sensors or the weapon.

18. The sight-weapon combination of claim 17, wherein said weapon is a heavy machine gun or mortar and is connected to said sight sensors such that said sight sensors control firing of said weapon.

19. The sight-weapon combination of claim 2, wherein said weapon is a heavy machine gun or mortar and is connected to said sight sensors such that said sight sensors control firing of said weapon.

20. The sight-weapon combination of claim 2, wherein the weapon has a magazine which is connected to the base module such that the weapon always follows the training of said at least one base module.

* * * * *